US008353565B2

(12) United States Patent
Saikawa

(10) Patent No.: US 8,353,565 B2
(45) Date of Patent: Jan. 15, 2013

(54) METHOD FOR REFILLING INK CARTRIDGE

(75) Inventor: Akihisa Saikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1019 days.

(21) Appl. No.: 12/138,338

(22) Filed: Jun. 12, 2008

(65) Prior Publication Data

US 2008/0309741 A1 Dec. 18, 2008

(30) Foreign Application Priority Data

Jun. 18, 2007 (JP) ..... 2007-160215

(51) Int. Cl.

| | |
|---|---|
| ***B41J 2/195*** | (2006.01) |
| ***B41J 29/393*** | (2006.01) |
| ***B41J 2/17*** | (2006.01) |
| ***B41J 2/175*** | (2006.01) |

(52) U.S. Cl. ..... 347/7; 347/19; 347/84; 347/86

(58) Field of Classification Search ..... 347/7
See application file for complete search history.

(56) References Cited

U.S. PATENT DOCUMENTS 4,672,842 A 6/1987 Hasselmann ..... 73/49.2

(Continued)

FOREIGN PATENT DOCUMENTS

| | | | |
|---|---|---|---|
| EP | 1241010 | | 9/2002 |
| EP | 1661710 | | 5/2006 |
| JP | 7309017 | | 11/1995 |
| JP | 8267775 | | 10/1996 |
| JP | 10034954 | | 2/1998 |
| JP | 2001310480 | A | 11/2001 |
| JP | 2004001540 | A | 1/2004 |
| KR | 10-0259605 | | 6/2000 |
| RU | 2083955 | C1 * | 7/1997 |
| WO | 0192017 | A1 | 12/2001 |
| WO | 2004/091920 | | 10/2004 |

OTHER PUBLICATIONS

Korean Notice of Allowance dated Nov. 26, 2010 from corresponding Korean Application No. 10-2008-0057223, and English language translation of the allowed claims.

Korean Office Action dated Apr. 29, 2010, from corresponding Korean Application No. 10-2008-57223.

(Continued)

*Primary Examiner* — Matthew Luu
*Assistant Examiner* — Erica Lin
(74) *Attorney, Agent, or Firm* — Fitzpatrick, Cella, Harper & Scinto

(57) ABSTRACT

An ink refilling method capable of refilling ink into at least two kinds of ink cartridges having different ink capacities and having substantially the same outer configurations, the method includes a step of discriminating the kind of the ink cartridge; a step of determining the capacity of the ink cartridge on the basis of a result of the discriminating step; and a step of filling, into the ink cartridge, an amount of the ink on the basis of the capacity determined in the determining step.

8 Claims, 11 Drawing Sheets

U.S. PATENT DOCUMENTS

| | | | | |
|---|---|---|---|---|
| 5,790,157 | A | 8/1998 | Higuma et al. | |
| 6,899,417 | B1 | 5/2005 | Shinada et al. | |
| 7,293,849 | B2 * | 11/2007 | Tani et al. | 347/6 |
| 2002/0105565 | A1 * | 8/2002 | Suda et al. | 347/85 |
| 2003/0218649 | A1 | 11/2003 | Kyung-Chool | 347/19 |
| 2006/0109320 | A1 * | 5/2006 | Cutler et al. | 347/84 |
| 2007/0085883 | A1 | 4/2007 | Nicodem | 347/86 |

OTHER PUBLICATIONS

Chinese Office Action dated Sep. 25, 2009, from corresponding Chinese Application No. 200810128918.9, and English language translation thereof.

European Search Report dated Nov. 5, 2008 from corresponding European Application No. 08158428.6.

* cited by examiner

METHOD FOR REFILLING INK CARTRIDGE

FIELD OF THE INVENTION AND RELATED ART

The present invention relates to a method for refilling an ink jet cartridge made up of an ink container portion having multiple ink storage chambers, and a recording head portion which records on recording medium by ejecting ink. More specifically, it relates to a method for efficiently refilling a substantial number of used opaque color ink jet cartridges (cartridges, whose interior are difficult to see), whose ink container portion and recording head portion are inseparable from each other, and which have multiple ink storage chambers and are the same in external appearance, but, are different in the ink capacity (absorbing member volume) of the ink storage chamber, in such a manner that each ink storage chamber is refilled with a proper amount of ink, that is, virtually the exact amount of ink necessary for filling up the ink storage chamber.

Incidentally, the present invention is also applicable to the method for refilling an ink jet cartridge for an ordinary printing apparatus, a copying machine, a facsimile machine, a wordprocessor with a printing portion, a multifunction recording apparatus capable of performing two or more of the functions of the preceding apparatuses, etc.

Regarding the method for supplying the recording head of an ink jet printer with ink, in the case of an ink jet recording apparatus which employs an ink jet cartridge, the main ink container and recording head of which are separable from each other, the main ink container is connected to the recording head with a piece of tube to supply the recording head with the ink from the main ink container. In the case of an ink jet recording apparatus, which employs an ink jet cartridge, the main ink container and recording head of which are inseparable from each other, the ink jet cartridge is removably mounted on the ink jet cartridge carriage, which is movable in a manner to scan the surface of recording medium.

If a main ink container, such as the one described above, or the ink container of an ink jet cartridge, which is inseparable from the recording head of the ink jet cartridge, becomes unusable because of ink consumption, for example, it is to be replaced with a new one.

In the past, some used ink jet cartridges were discarded. In recent years, however, people has become highly concerned with environmental preservation, fostering a social movement that demands ink jet cartridge makers to recover (collect) as many used ink jet head cartridges as possible and utilize the used ink jet head cartridge as a fresh supply of resource.

Further, in order to deal with this social concern, some ink jet cartridge makers have been studying the possibility of efficiently reusing the recovered ink jet cartridges.

For example, Japanese Laid-open Patent Application H07-309017 proposes a method for reusing recovered monochromatic ink jet recording head cartridges. According to this method, the amount of ink remainder in a used ink container is obtained by measuring the weight of the ink container, and then, the amount by which the used ink container is to be refilled with ink is determined by comparing the amount by which the used ink container was initially filled with ink, with the measured amount of ink remainder in the used ink container. International Patent Publication WO 01/092017 proposes to fill a used ink container with ink by an amount which can be calculated from the amount of ink consumption stored in a data storage means.

The ink jet cartridges removably mountable on an ink jet cartridge carriage can be roughly classified into two groups, that is, a group in which an ink jet cartridge is structured so that its recording head and ink container are separable from each other, and a group in which an ink jet cartridge is structured so that its recording head and ink container are integrated (not separable). If an ink jet cartridge belonging to the first group becomes unusable because of ink consumption, only the ink container is replaced. In the case of an ink jet cartridge belonging to the second group, however, if the ink jet cartridge becomes unusable because of ink consumption, the entirety of the ink jet cartridge is replaced. As examples of an ink jet cartridge belonging to the second group, there are multicolor ink jet cartridges, in particular, multicolor ink jet cartridges made up of an ink container having yellow, cyan, and magenta ink storage chambers, and a recording head inseparably attached to the ink container.

Japanese Laid-open Patent Application 2001-310480 discloses an ink jet cartridge which can be changed in ink capacity (absorbing member volume) according to its usage, without changing it in external appearance.

SUMMARY OF THE INVENTION

In the case of a used multicolor ink jet cartridge, that is, a used ink jet cartridge which stores two or more inks different in color, it is difficult to determine the amount by which each ink storage chamber is to be refilled with ink, simply by measuring the weight of the used ink jet cartridge as proposed in Japanese Laid-open Patent Application H07-309017.

Further, the inks (yellow, magenta, and cyan inks, for example) stored in a multicolor ink jet cartridge are different in the cumulative amount by which they are used (ejected). Therefore, simply measuring the weight of a multicolor ink jet cartridge is not enough to accurately determine the amount by which each of the ink storage chambers of the multicolor ink jet cartridge is to be refilled with ink.

On the other hand, in a case where the cumulative amount of ink consumption is stored in the data storage means of an ink jet cartridge as disclosed in International Patent Publication WO 01/092017, the information storage means must be capable of storing the cumulative amount of consumption for each of the multiple inks. In other words, an expensive data storage means is required. In addition, if a used ink jet cartridge (ink storage chamber or chambers) is refilled with ink by a user, the information in the data storage means becomes unreliable.

Further, in the case of an ink jet cartridge, such as the one disclosed in Japanese Laidopen Patent Application 2001-310480, which can be changed in ink capacity (absorbing member volume) without changing it in external appearance, it is impossible to accurately determine the volume of the absorbing member therein, based on its external appearance. Thus, the amount by which a used ink jet cartridge of this type was to be filled was kept substantially smaller than the exact amount of ink necessary to filling up the used ink jet cartridge, in order to prevent the problem that the ink jet cartridge is overfilled; while an ink storage chamber is refilled, ink begins to overflow from the refilled ink storage chamber.

Thus, the primary object of the present invention is to provide a method for refilling a substantial number of opaque color ink jet cartridges (cartridges, the interior of which are difficult to see), the ink container and recording head of which are inseparable from each other, and which have multiple ink storage chambers and are the same in external appearance, but, are different in the ink capacity (absorbing member volume) of the ink storage chamber, in such a manner that each ink storage chamber is refilled with a proper amount of ink, that is, virtually the exact amount of ink necessary for filling up the ink storage chamber.

According to an aspect of the present invention, there is provided an ink refilling method capable of refilling ink into at least two kinds of ink cartridges having different ink capacities and having substantially the same outer configurations, said method comprising a step of discriminating the kind of the ink cartridge a step of determining the capacity of the ink cartridge on the basis of a result of said discriminating step; and a step of filling, into the ink cartridge, an amount of the ink on the basis of the capacity determined in said determining step.

In the aspect of the present invention, the method may further comprises a step of determining the amounts of the ink to be filled into the respective ink accommodating portions, said filling amount determining step including a step of measuring remaining amounts of the ink in the respective accommodating portions, wherein said filling amount determining step determines the filling amounts on the basis of differences between the ink capacities determined by said ink capacity determining step and the remaining amounts of the ink measured by said measuring step, respectively.

The present invention makes it possible to efficiently refill a substantial number of color ink jet cartridges, the ink container and recording head of which are inseparable from each other, and which are the same in external appearance, but, are different in the ink capacity (absorbing member) of each ink storage chamber thereof, in such a manner that each ink storage chamber is refilled with a proper amount of ink, that is, virtually the exact amount of ink necessary for filling up the ink storage chamber.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7(*c*) being a sectional view of the mini ink jet cartridge in accordance with the present invention, and the pair of hole making means having just finished drilling a pair of holes through the top lid of the ink container portion of the ink jet cartridge.

DETAILED DESCRIPTION OF THE PREFERRED EMBODIMENTS

Hereinafter, the preferred embodiments of the present invention will be described with reference to the appended drawing.

Figure 1:
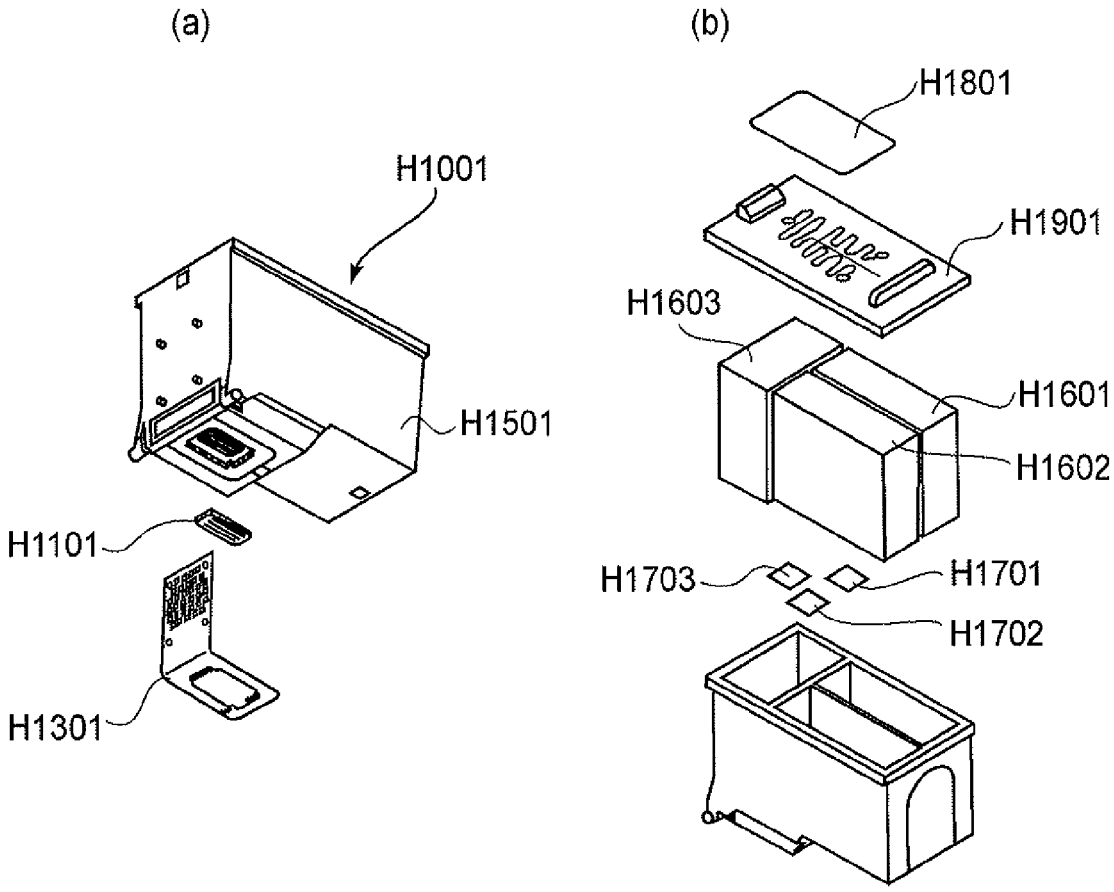
FIG. 1(*a*) is an exploded perspective view of the recording head portion of an ink jet cartridge (of typical shape and standard size) in accordance with the present invention, and FIG. 1(*b*) is an exploded perspective view of the ink container portion of the ink jet cartridge (of typical shape and standard size).

FIG. 1 is a schematic perspective view of one of the preferable ink jet cartridges to which the present invention is applicable, and shows the general structure of the cartridge.

Figure 2:
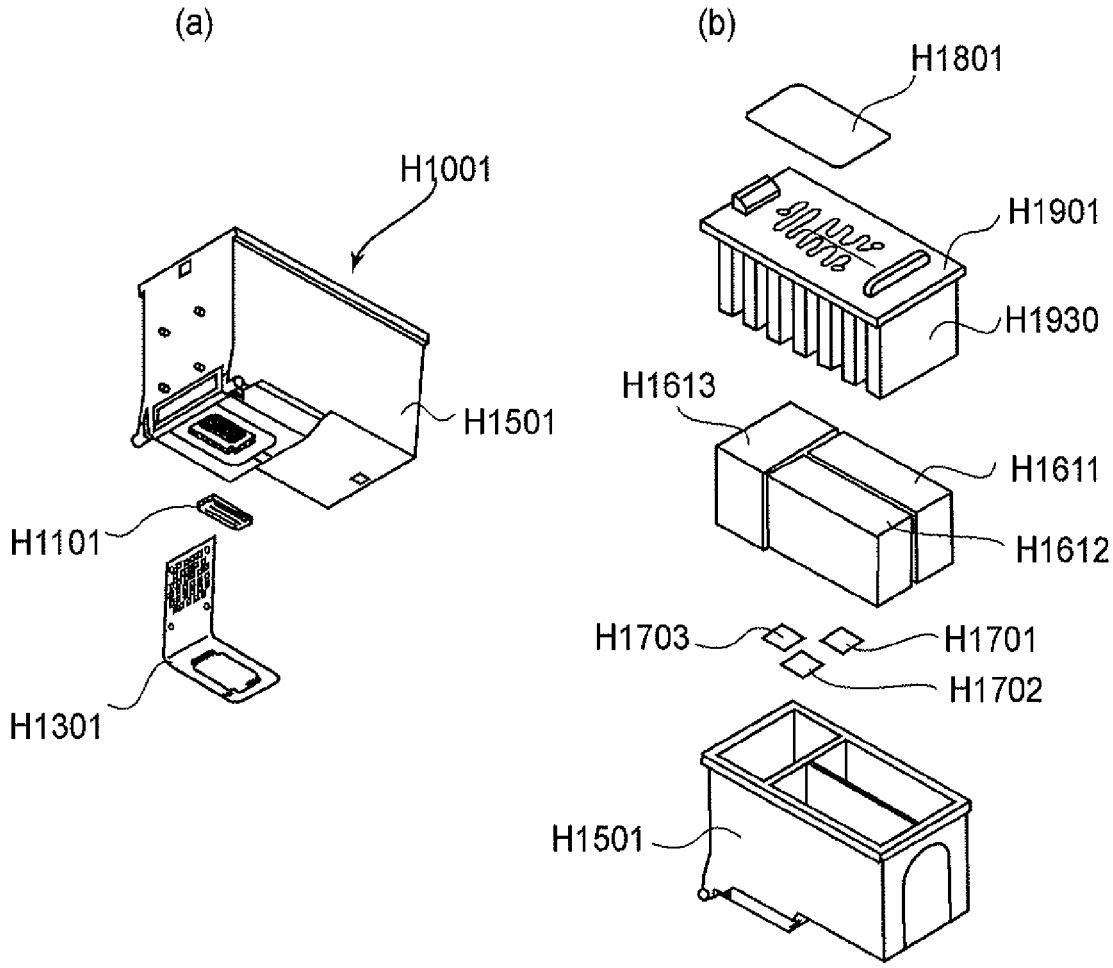
FIG. 2(*a*) is an exploded perspective view of the recording head portion of an ink jet cartridge (of typical shape and mini size) in accordance with the present invention, and FIG. 2(*b*) is an exploded perspective view of the ink container portion of the ink jet cartridge (of typical shape and mini size).
Figure 3:
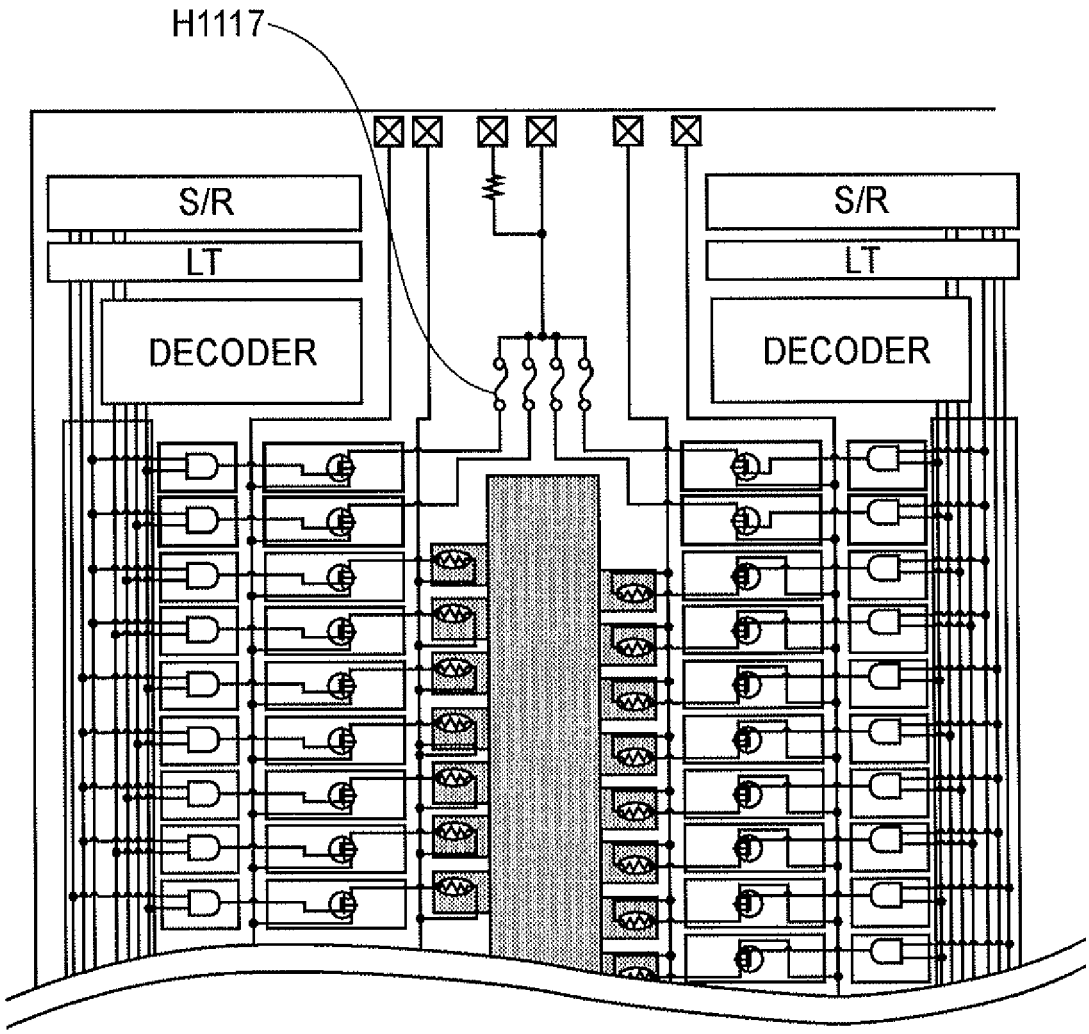
FIG. 3 is a schematic partial plan view of the recording head chip of an ink jet cartridge in accordance with the present invention.

The ink jet cartridge shown in FIG. 1 is made up of a recording head and an ink container, which are inseparable from each other. It is an ink jet cartridge of a large ink capacity. FIG. 2 is a schematic perspective view of another preferable ink jet cartridge to which the present invention is applicable, and shows the general structure of the cartridge. The ink jet cartridge shown in FIG. 2 is the same in external appearance, but, is smaller in ink capacity. FIG. 3 is a schematic partial plan view of the recording head chip of the ink jet cartridge, and shows the general structure of the chip. Incidentally, ink jet cartridges to which the present invention is applicable ink container portions which are made of an opaque material, that is, the internal structure of which cannot be confirmed from outside.

Next, the structural components of this ink jet cartridge will be described with reference to the drawings.

FIG. 1(*a*) is an exploded perspective view of the recording head portion of the ink jet cartridge in accordance with the present invention, and FIG. 1(*b*) is an exploded perspective view of the ink container portion of the ink jet cartridge. As will be evident from FIG. 1, this ink jet cartridge is made up of a recording head H1002, and an ink container H1003, which are inseparable from each other. The recording head H1002 ejects color inks (cyan, magenta, and yellow inks) onto recording medium. It is made up of a recording element chip H1101 and an electrical wiring tape H1301. The electrical wiring tape H1301 transmits the signals from the main assembly of the printer to the recording element chip H1101. The ink container H1003 has three ink storage chambers for storing three color inks, different in color, one for one. It also has three ink absorbing members H1601, H1602, and H1603, which are stored in the three ink storage chambers, one for one. The ink container H1003 is also provided with three filters H1701, H1702, and H1703, which correspond to the three ink absorbing members H1601, H1602, and H1603, respectively. Each filter is located at the junction between each ink storage chamber and the ink path which leads to the recording head H1002. The top of the ink container is covered with a lid H1901. The top surface of the lid H1901 is covered with a sheet H1801, which is pasted to the top surface of the lid H1901 in a manner to cover the grooves cut, as air passages (vents), in the outward surface of the lid H1901.

Referring to FIG. 3, the recording element chip H1101 is provided with electrical wiring, fuses H1117, resistors, electrodes, etc. It is also provided with ink passage walls, ink ejection nozzles, etc., which are formed of resinous material, on the substrate of the recording element chip H1101, with the use of electrophotographic technologies, in a manner to cover the abovementioned components. The electrodes for supplying the electrical wiring with electric power are provided with bumps, which are formed of Au, or the like.

FIG. 2 is a schematic perspective view of another preferable ink jet cartridge to which the present invention is applicable, and shows the general structure of the cartridge. The ink jet cartridge shown in FIG. 2 is the same in external appearance as the ink jet cartridge shown in FIG. 1, but, is smaller in the volume of the absorbing member stored in each of the ink storage chamber, being therefore smaller in ink capacity, than the ink jet cartridge shown in FIG. 1. In comparison to the ink jet cartridge shown in FIG. 1, it may be reasonable for the ink jet cartridge shown in FIG. 2 to be referred to as an ink jet cartridge of a mini-size (which hereafter will be referred as mini ink jet cartridge). FIG. 2(*a*) is an exploded perspective view of the recording head portion of the mini ink jet cartridge, and FIG. 2(*b*) is an exploded perspective view of the ink container portion of the mini ink jet cartridge.

Referring to FIG. 2, the mini ink jet cartridge is the same in external shape and size as the standard ink jet cartridge shown in FIG. 1. The mini ink jet cartridge is made up of the recording element chip H1101, electrical wiring tape H1301, main structure H1501, filters H1701, H1702, and H1703, ink absorbing member H1611, H1612, and H1613, top lid H1901, and seal H1801. The ink absorbing members H1611, H1612, and H1613 of this ink jet cartridge are smaller in capacity than those of the standard ink jet cartridge shown in FIG. 1. Further, the top lid 1901 of this ink jet cartridge is provided with ribs H1930.

Hereafter, the preferred embodiments of the present invention will be described with reference to the standard and mini ink jet cartridges and the method for refilling the two ink jet cartridges.

However, the present invention is also applicable to ink jet cartridges other than the standard and mini ink jet cartridges.

Next, the preferred embodiments of the present invention will be described in detail.

[Embodiment 1]

Into the absorbing members H1601, H1602, and H1603 of the standard ink jet cartridge shown in FIG. 1, yellow, cyan, and magenta inks are injected, respectively. In the absorbing members H1611, H1612, and H1613 of the mini ink jet cartridge shown in FIG. 2, yellow, cyan, and magenta inks are injected, respectively. The absorbing members of the mini ink jet cartridge are roughly 15 mm in height, and capable of holding roughly 5 g of ink. The absorbing members of the standard ink jet cartridge are roughly 30 mm in height, and are capable of holding roughly 10 g of ink.

Hereafter, one of the proper methods for refilling the recovered standard and mini ink jet cartridges, which are different in ink capacity while being the same in external appearance, will be described with reference to FIGS. 4-10.

Figure 4:
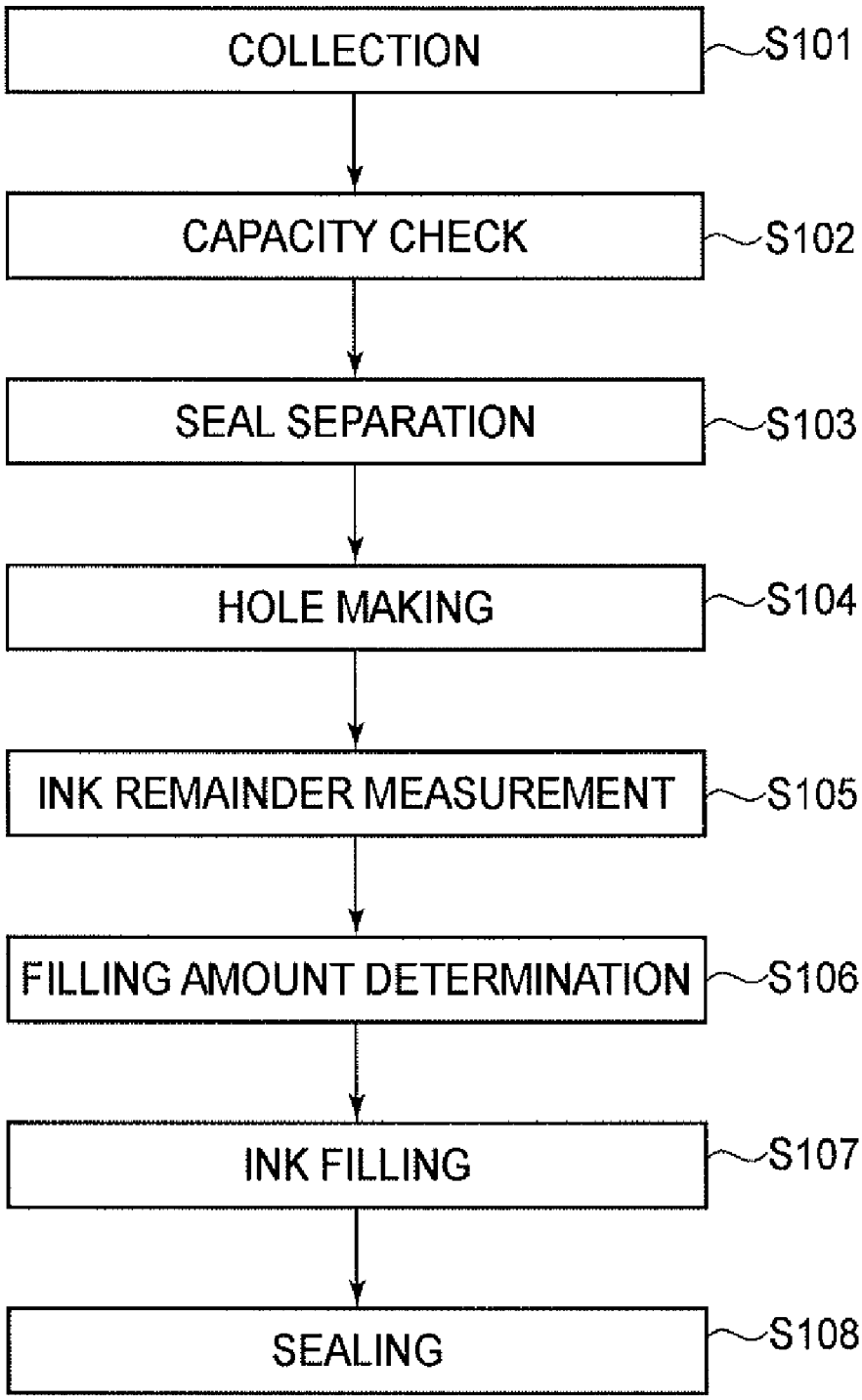
FIG. 4 is a flowchart of the process for refilling a used ink jet cartridge, in the first embodiment of the present invention.

FIG. 4 is a flowchart of the process for refilling an ink jet cartridges with ink, in the first embodiment.

In the first embodiment, the process for refilling a recovered ink jet cartridge with ink has a "recovery (collecting) step: S101", which is for recovering a used ink jet cartridges, a "absorbing member capacity finding step: S102", which is for finding the capacity of one of the absorbing members in the recovered ink jet cartridge, a "seal separating step: S103", which is for separating the seal from the recovered ink jet cartridge, a "hole making step: S104", which is for making holes through the top lid of the recovered ink jet cartridge, an "ink remainder amount measuring step: S105", which is for measuring the amount of ink remainder in the recovered ink jet cartridge, an "ink injection amount deciding step: S106", which is for deciding the amount of ink to be injected into one of ink storage chambers of the recovered ink jet cartridge, an "ink injecting step: S107", which is for injecting ink into one of the ink storage chambers of the recovered ink jet cartridge, and a "seal pasting step: S108", which is for pasting a seal to the refilled ink jet cartridge after all the ink storage chambers are refilled. Obviously, a recovered ink jet cartridge can be refilled with ink using only a part, or parts, of the above described process for refilling a recovered ink jet cartridge. Further, the process may be changed in the order in which the abovementioned steps are carried out. These modifications of the above described used ink jet cartridge refilling process are within the technical gist of the present invention.

Used ink jet cartridges are recovered in the "recovery step: S101". Incidentally, some used ink jet cartridges are directly brought to an ink jet cartridge recycling plant, whereas the others are indirectly recovered, that is, by way of recovery stations located in local stores, or through recycling movement, etc.

The recovered used ink jet cartridges are sent to the "absorbing member capacity finding step: S102".

In a case where a used ink jet cartridge, the label of which has not been peeled away by a user or the like, is directly brought in, and it is sure that this ink jet cartridge has not been refilled, the absorbing member capacity of this used ink jet cartridge may be determined based on the information on the label on the ink jet cartridge.

However, if it is impossible to identify the recovery route of a recovered used ink jet cartridge, because the seal (label H1801 shown in FIGS. 1 and 2) pasted to the ink jet cartridge had been lost (peeled off) while the cartridge was used, while the cartridge was recovered, or in the like situations, it is impossible to find out the absorbing member capacity of the cartridge, based on the seal (label). In such a case, the absorbing member capacity may be found out by removing the top lid H1901, or by making hole(s) through the top lid H1901 or the like to find out the type of the absorbing member in the cartridge.

Figure 5:
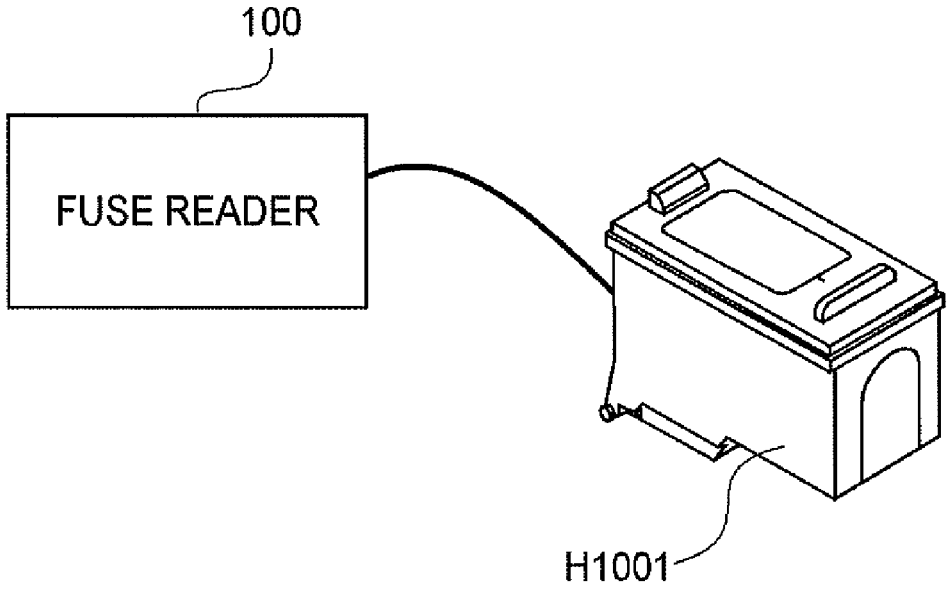
FIG. 5 is a schematic drawing for describing the "absorbing member capacity finding step" in the first embodiment of the present invention.

Referring to FIG. 3, the recording element chip H1101 of this ink jet cartridge is provided with the fuses H1117. The fuse H1117 stores information, such as recording head type and ink storage chamber capacity (absorbing member capacity). In other words, it functions as a data storage means for identifying a recovered used ink jet cartridge. Referring to FIG. 5, in this embodiment, the absorbing member capacity of a recovered used ink jet cartridge is found out by reading the information provided by the fuse H1117, with the use of a fuse reading device 100.

Figure 6:
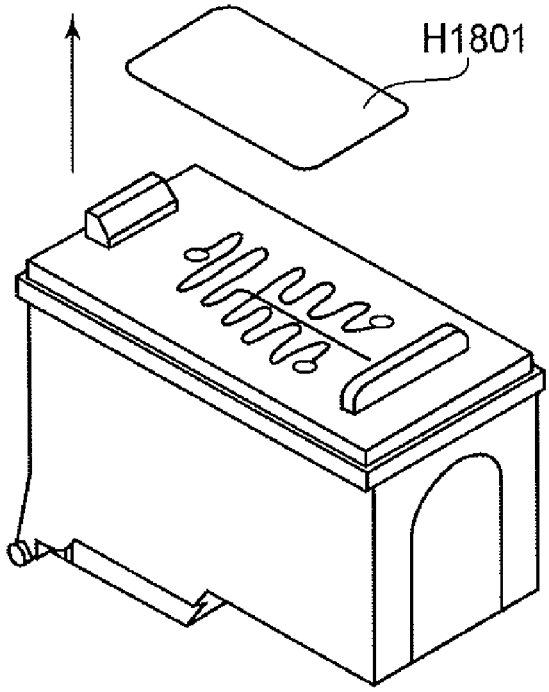
FIG. 6 is a schematic drawing for describing the "seal separating step" in the first embodiment of the present invention.

Next, the "seal separating step: S103" shown in FIG. 6, is carried out. However, it is possible that the seal (label) will have been lost (peeled off) through usage, recovery process, or the like, as described above. In such a case, this step (S103) may be skipped.

Next, the "hole making step: S104" is carried out, which will be described with reference to FIG. 7 and the case in which one of the ink storage chambers of the ink jet cartridge is filled with cyan ink.

Figure 7:
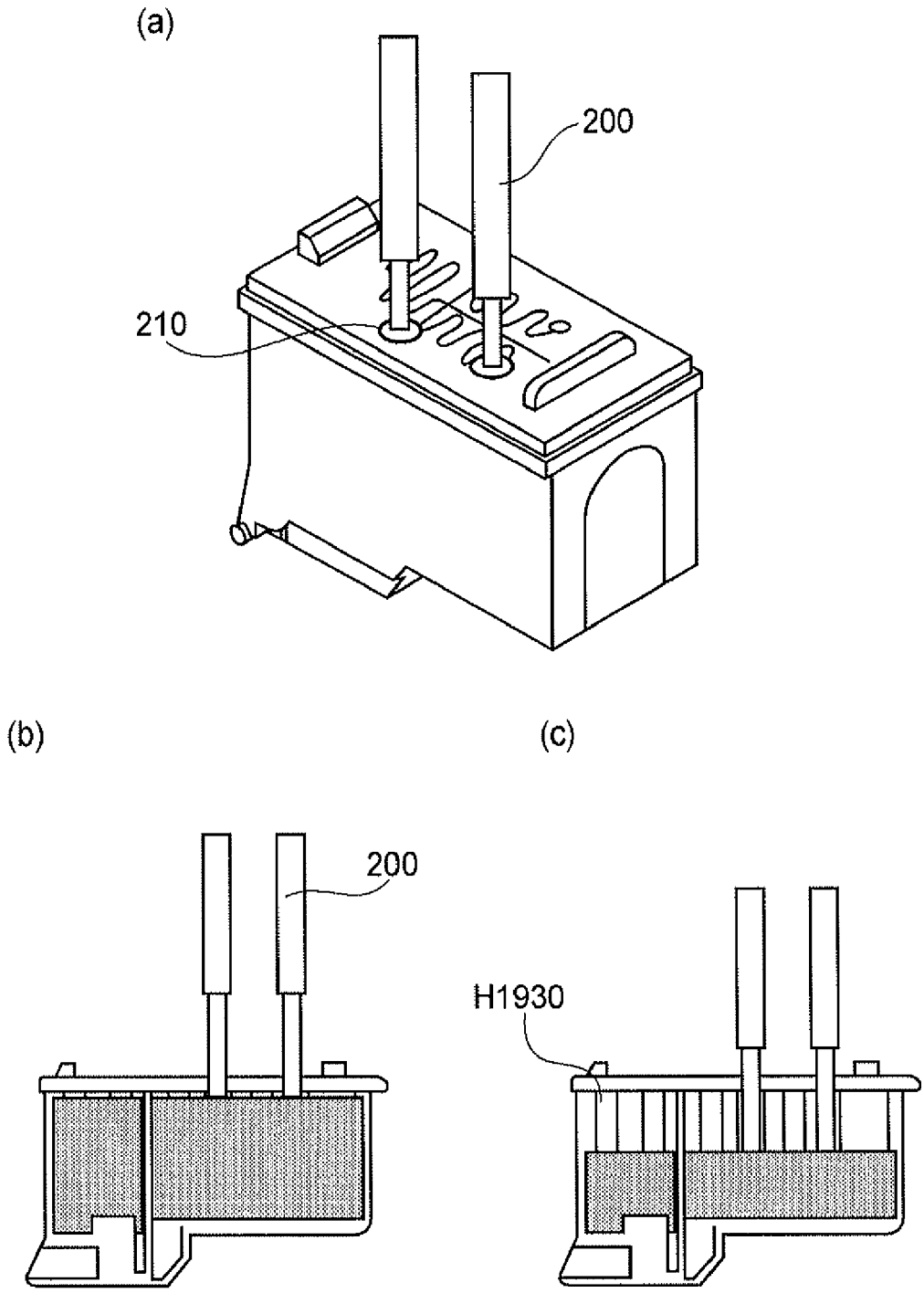
FIG. 7 is a schematic drawing for describing the "hole making step" in the first embodiment of the present invention, 7(*a*) being a schematic perspective view of an ink jet cartridge in accordance with the present invention, and a pair of hole making means which are being used to drill a pair of holes through the top lid of the ink container portion of the ink jet cartridge, FIG. 7(*b*) being a sectional view of the standard ink jet head cartridge, and the pair of hole making means having just finished drilling a pair of holes through the top lid of the ink container portion of the ink jet cartridge.

Referring to FIG. 7(*a*), a pair of holes 210 are made through the portion of the top lid H1901, which corresponds to the ink storage chamber for cyan ink, with the use of a tool such as a drill. Incidentally, FIG. 7(*a*) shows only the holes which correspond to the ink storage chamber for cyan ink. It is not intended to limit the present invention in terms of the size and number of the holes 210.

In the "hole making step: S104", the depth to which the drills 200 are to be inserted into the ink storage chamber is adjusted according to the ink jet cartridge type identified in the above described "absorbing member capacity finding step: S102". FIGS. 7(*b*) and 7(*c*) are for showing the difference between the standard and mini ink jet cartridges, in terms of the depth to which the drills 200 are to be inserted into the ink storage chamber. In the case of the standard ink jet cartridge, the depth to which the drills 200 are to be inserted has only to be roughly 1 cm from the top surface of the top lid H1901. In the case of the mini ink jet cartridge, however, the top lid H1901 is provided with multiple ribs H1930, which extend inward of each ink storage chamber. Therefore, it sometimes occur that holes have to be drilled through one or more of the ribs H1930, although whether or not the holes have to be drilled through the ribs depends on the size of the holes. Thus, when making the holes 210 through the top lid H1901 of the mini ink jet cartridge, the drills 200 have to inserted further into the ink jet cartridge by roughly 2 cm than when making the holes 210 through the top lid H1901 of the standard ink jet cartridge. Therefore, in consideration of the possibility that the holes 210 will have to be drilled through the rib H1930 or ribs H1930, the depth to which the drills 200 are to be inserted into the mini ink jet cartridge is set to be just enough for the drills 200 to come into contact with the absorbing member.

Next, the "ink remainder amount deciding step: S106" will be described.

The color inks in a color ink jet cartridge which stores two or more inks are different in the amount by which they are consumed. Further, the amount by which each of the color inks is used is affected by the condition and/or situation in which the color ink jet cartridge is used. Therefore, the ink storage chambers of a recovered color ink jet cartridge may be different in the amount of the ink remainder therein. Therefore, it is reasonable to think that simply refilling a recovered used color ink jet cartridge may result in the problem that the ink storage chambers of the ink jet cartridge are different in the amount of the ink therein after the refilling, and/or the problem that one or more inks overflow from the ink jet cartridge (ink storage chambers). This is why it is necessary to measure the amount of the ink remainder in each ink storage chamber, in order to determine the accurate amount by which each ink storage chamber is to be refilled with ink.

Figure 8:
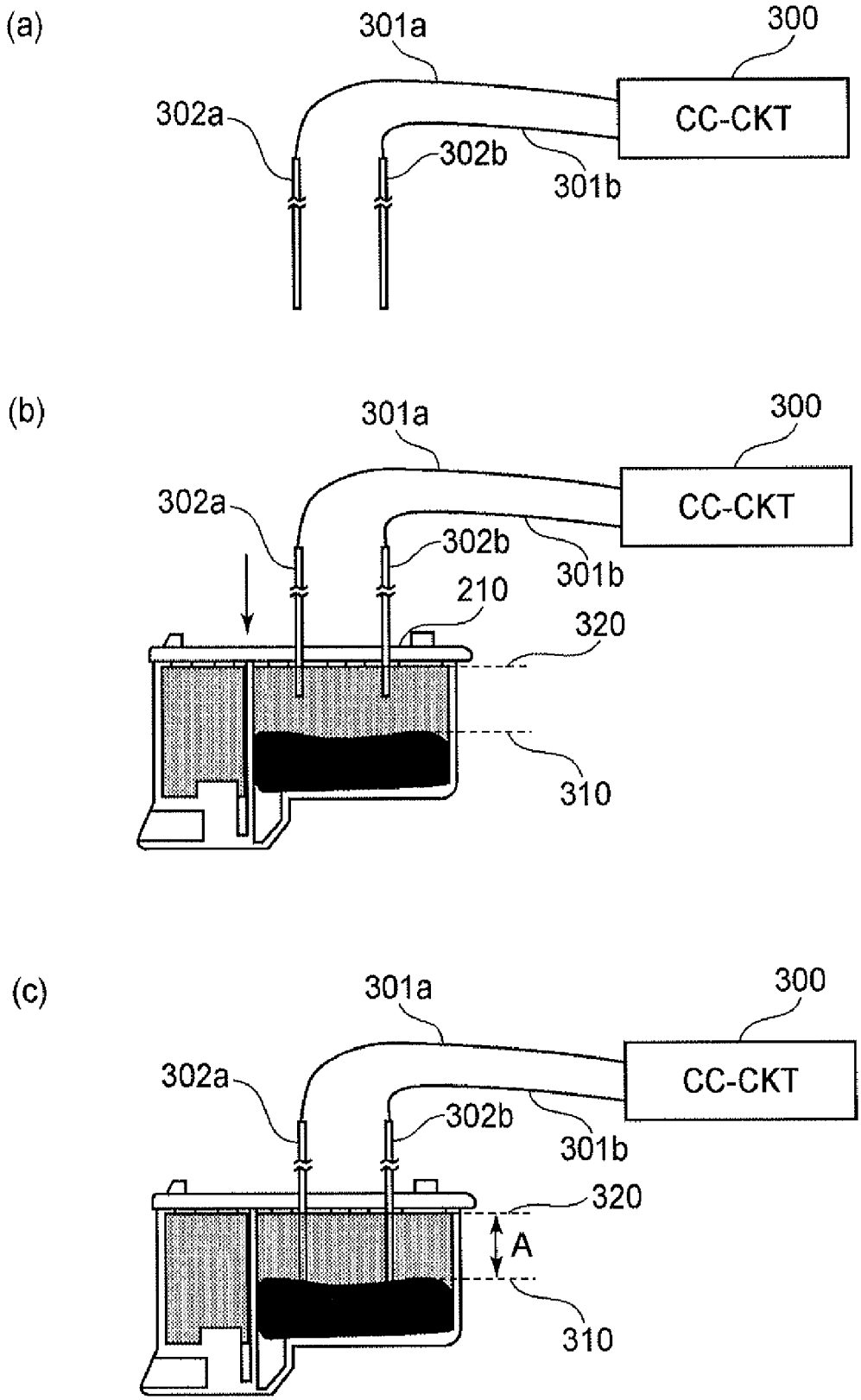
FIG. 8 is a schematic drawing for describing the "ink remainder amount measuring step" in the first embodiment of the present invention, FIG. 5*a*) being a schematic drawing for describing the general structure of the ink remainder amount detecting device used in the "ink remainder amount measuring step", FIG. 8(*b*) being a combination of the schematic sectional view of the standard ink jet cartridge, and the schematic drawing of the ink remainder amount detecting device which is in the middle of the "ink remainder amount measuring step", and FIG. 8(*c*) being a combination of the schematic sectional view of the standard ink jet cartridge, and the schematic drawing of the ink remainder amount detecting device which is at the end of the "ink remainder amount measuring step".

FIG. 8(*a*) shows an apparatus to be used for the "ink remainder amount measuring step". Next, the apparatus used for measuring the amount of the ink remaining in each ink storage chamber will be described with reference to FIG. 8(*a*). The ink remainder amount measuring apparatus is provided with a pair of electrodes 302 (302*a* and 302*b*) formed of a metallic material. One end of the electrode 302*a* is connected to one end of an electrical lead wire 301*a*. One end electrode 302*b* is connected to one end of an electrical lead wire 301*b*. The other ends of the electrical lead wires 301*a* and 301*b* are connected to a constant current circuit 300 for measuring the voltage between the electrodes 302*a* and 302*b*. The constant current circuit 300 is designed so that 100 μm of DC voltage flows between the electrodes 302*a* and 302*b*, with the maximum amount of voltage set to 5 V, for example.

Next, referring to FIGS. 8(*b*) and 8(*c*), the method for measuring the amount of the ink remainder in each ink storage chamber of the color ink jet cartridge will be described. As the ink in each ink storage chamber consumed, the interface 310 between the air and the body of ink in the absorbing member gradually falls. Thus, if the position of the interface 310 can be detected, the amount of the ink remainder in the ink storage chamber can be calculated.

Figure 9:
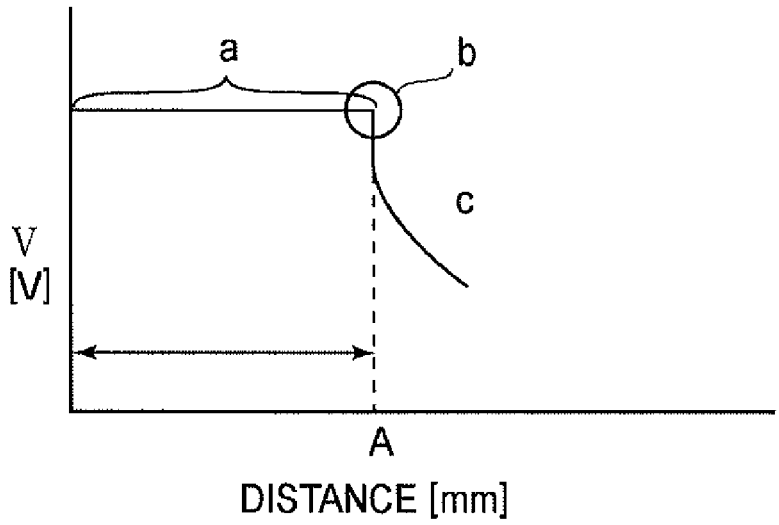
FIG. 9 is a graph showing the relationship between the distance by which a pair of electrodes are inserted into the absorbent member from the top surface of the absorbent member, and voltage between the pair of electrodes.

FIG. 8(*b*) represents a case in which the electrodes 302 have not reached the interface 310 in the absorbing member, whereas FIG. 8(*c*) represents a case in which the electrodes 302 have reached the interface 310 in the absorbing member. A referential letter A designates the distance from the top surface of the absorbing member to the interface 310 between the air and the body of ink in the absorbing member. FIG. 9 is a graph showing the relationship between the distance by which the electrodes 302 were inserted into the absorbing member from the top surface of the absorbing member, and the voltage between the two electrodes 302.

Referring to FIG. 8(*b*), the electrodes 302 are gradually inserted into the absorbing member through the holes 210 created in "hole making step: S104", while the voltage between the two electrodes 302 is measured. Until the electrodes 302 come into contact with the interface 310, there is no ink between the electrodes 302*a* and 302*b*, and therefore, there is no electrical connection between the electrodes 302*a* and 302*b*. Therefore, the voltage between the electrodes 302*a* and 302*b* remains at a high level as it is in a range a in FIG. 9(*a*).

However, as the electrodes 302 reach the interface 310 as shown in FIG. 8(*c*), electrical connection is established between the two electrodes 302*a* and 302*b* through ink, changing thereby the voltage between the electrodes 302*a* and 302*b*. Where this voltage change occurs corresponds to a point b in FIG. 9.

The distance A from the top surface of the absorbing member to the interface 310 between the air and the body of ink in the absorbing member can be determined based on this change in the voltage.

TABLE 1

| Distance A from absorbing member top to ink (mm) | Small size | Standard size |
|---|---|---|
| 0 ≦ A < 2 | 0.0 | 0.0 |
| 2 ≦ A < 4 | 0.7 | 0.7 |
| 4 ≦ A < 6 | 1.4 | 1.4 |
| 6 ≦ A < 8 | 2.1 | 2.1 |
| 8 ≦ A < 10 | 2.8 | 2.8 |
| 10 ≦ A < 12 | 3.5 | 3.6 |
| 12 ≦ A < 14 | 4.2 | 4.3 |
| 14 ≦ A < 16 | 5.0 | 5.0 |
| 16 ≦ A < 18 | — | 5.7 |
| 18 ≦ A < 20 | — | 6.4 |
| 20 ≦ A < 22 | — | 7.1 |
| 22 ≦ A < 24 | — | 7.8 |
| 24 ≦ A < 26 | — | 8.5 |
| 26 ≦ A < 28 | — | 9.2 |
| 28 ≦ A < 30 | — | 10.0 |
| 30 ≦ A < 32 | — | — |
| 32 ≦ A < 34 | — | — |

Next, the "ink remainder amount deciding step: S106" will be described. Table 1 is for the "ink remainder amount deciding step: S106". As described above, each of the absorbing members of the mini ink jet cartridge is roughly 15 mm in height, and is capable of holding roughly 5 g of ink, whereas each of the absorbing members of the standard ink jet cartridge is roughly 30 mm in height, and is capable of holding roughly 10 g of ink.

First, whether a recovered used ink jet cartridge is mini or standard is decided based on the information obtained in the "absorbing member capacity finding step: S102".

Then, the amount by which ink is to be injected into the ink storage chamber is calculated based on the difference between the full ink capacity of the ink storage chamber, and the amount of ink remainder in the ink storage chamber (absorbing member), which is obtained in the "ink remainder amount deciding step: S106", with the use of Table 1, which shows the relationship between the distance A from the top surface of the absorbing member to the interface 30 in the absorbing member. In this embodiment, the distance from the top surface of the absorbing member to the interface 30 in the absorbing member was classified with a 2 mm interval. However, an interval other than 2 mm may be used.

Next, the "ink injecting step: S107" is taken.

Figure 10:
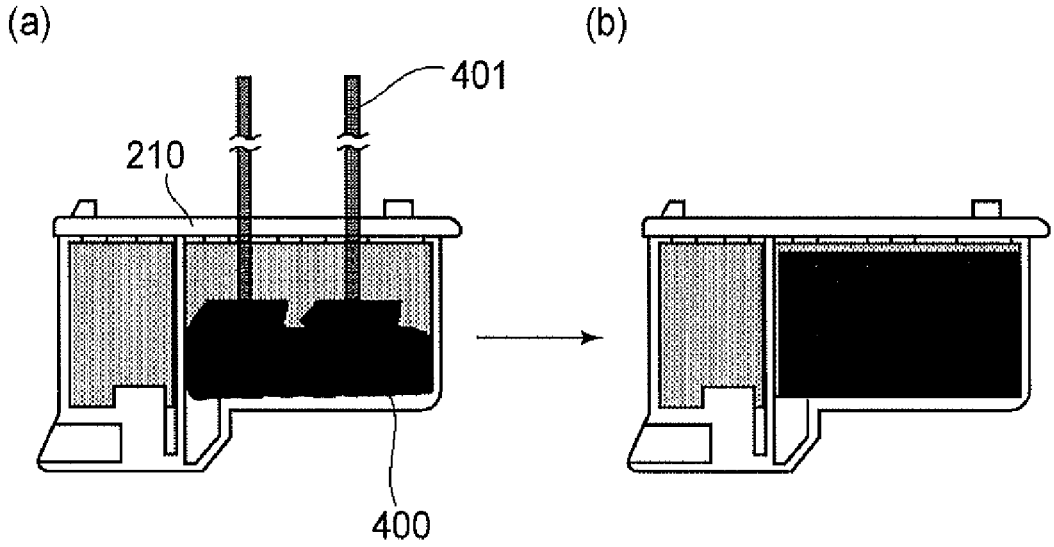
FIG. 10(*a*) is a sectional view of the ink jet cartridge, and a pair of ink injection tubes through which ink is being injected into one of the ink storage chambers of the ink container portion of the ink jet cartridge, in the first embodiment, and FIG. 10(*b*) is a schematic sectional view of the ink jet cartridge in the first embodiment, one of the ink storage chambers of which has just been refilled to its full capacity.

FIG. 10 is for describing "ink injecting step: S107". Referring to FIG. 10(*a*), ink is injected into an ink storage chamber (absorbing member) by the amount decided in the "ink injection amount deciding step: S106", through the holes made in the "hole making step: S104", with the use of a pair of ink injection needles 401 (ink injecting devices) put though the holes, one for one. The amount by which ink is injected into the ink storage chamber (absorbing member) is decided through the steps, such as those described above, based on the absorbing member capacity and amount of ink remainder. Therefore, the ink storage chamber (absorbing member) is perfectly refilled with ink as shown in FIG. 10(*b*); it does not occur that the ink storage chamber is overfilled, or insufficiently filled, with ink.

This concludes the process of refilling the cyan ink storage chamber of the recovered multicolor ink jet cartridge with cyan ink. Then, the same process as that carried out to refill the cyan ink storage chamber with cyan ink is carried out for the magenta ink storage chamber and yellow ink storage chamber to finish refilling the recovered multicolor ink jet cartridge.

In the above, the method for sequentially refilling the multiple (three) ink storage chambers was described. However, the three ink storage chambers may be refilled at the same time. Further, the color ink refilling process may be structured so that a random combination of two among the three ink storage chambers is refilled at the same time, whereas the other is refilled separately from the two. Whether the multiple ink storage chambers are to be sequentially refilled or at the same time, or whether two among the three ink storage chambers are to be refilled at the same time, whereas the other is refilled separately from the two, may be decided based on the type of the available ink injecting device, or the like factors.

Next, the "seal pasting step: S108" will be described.

Figure 11:
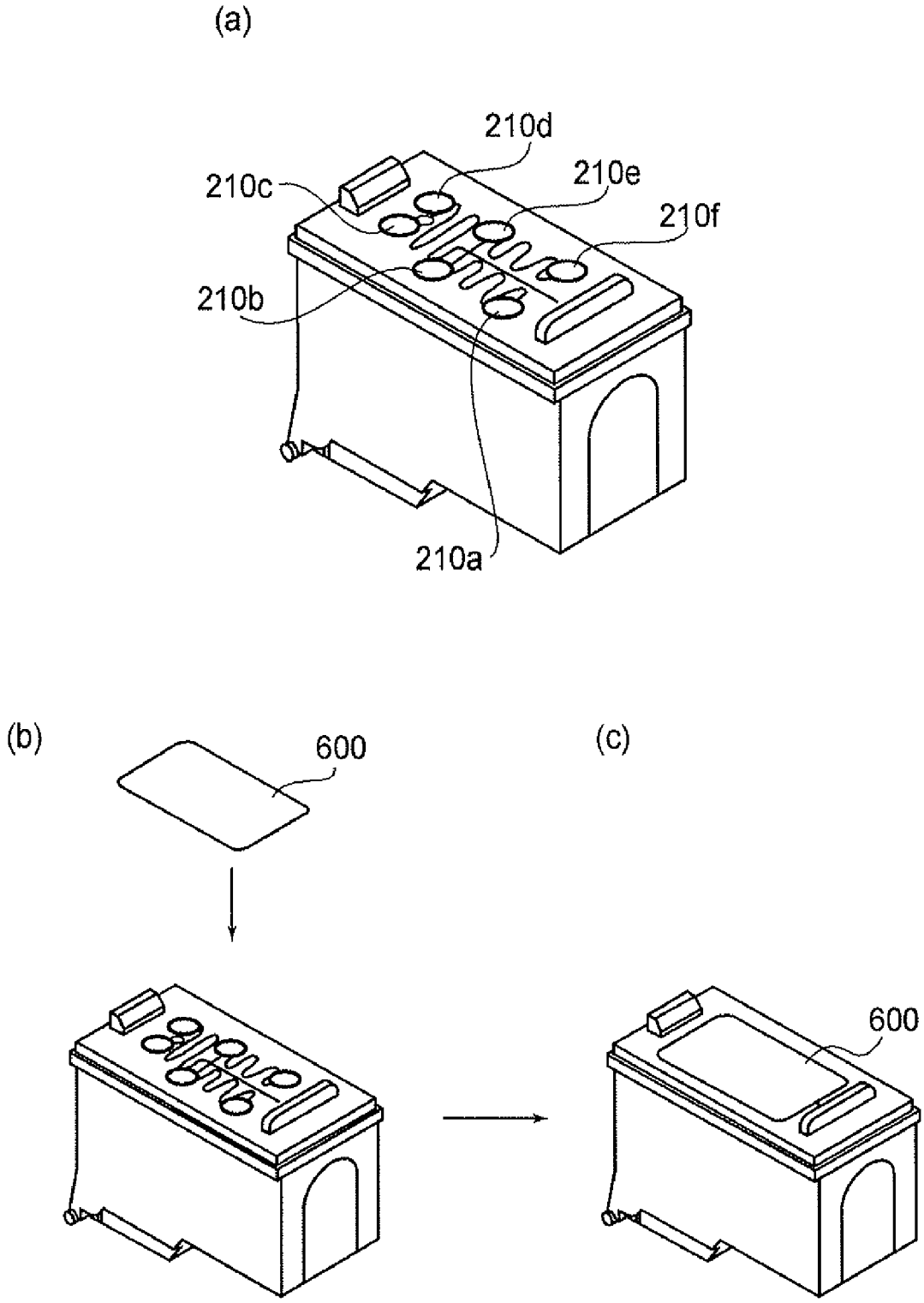
FIG. 11 is a schematic drawing for describing the "seal pasting step" in the first embodiment of the present invention, FIG. 11(*a*) being a schematic perspective view of the ink jet cartridge, the ink storage chambers of which have just been refilled with ink to their full capacity, FIG. 11(*b*) being a schematic perspective view of the ink jet cartridge, to which a seal is ready to be pasted, and FIG. 11(*c*) being a schematic perspective view of the ink jet cartridge to which the seal has just been pasted.
Figure 12:
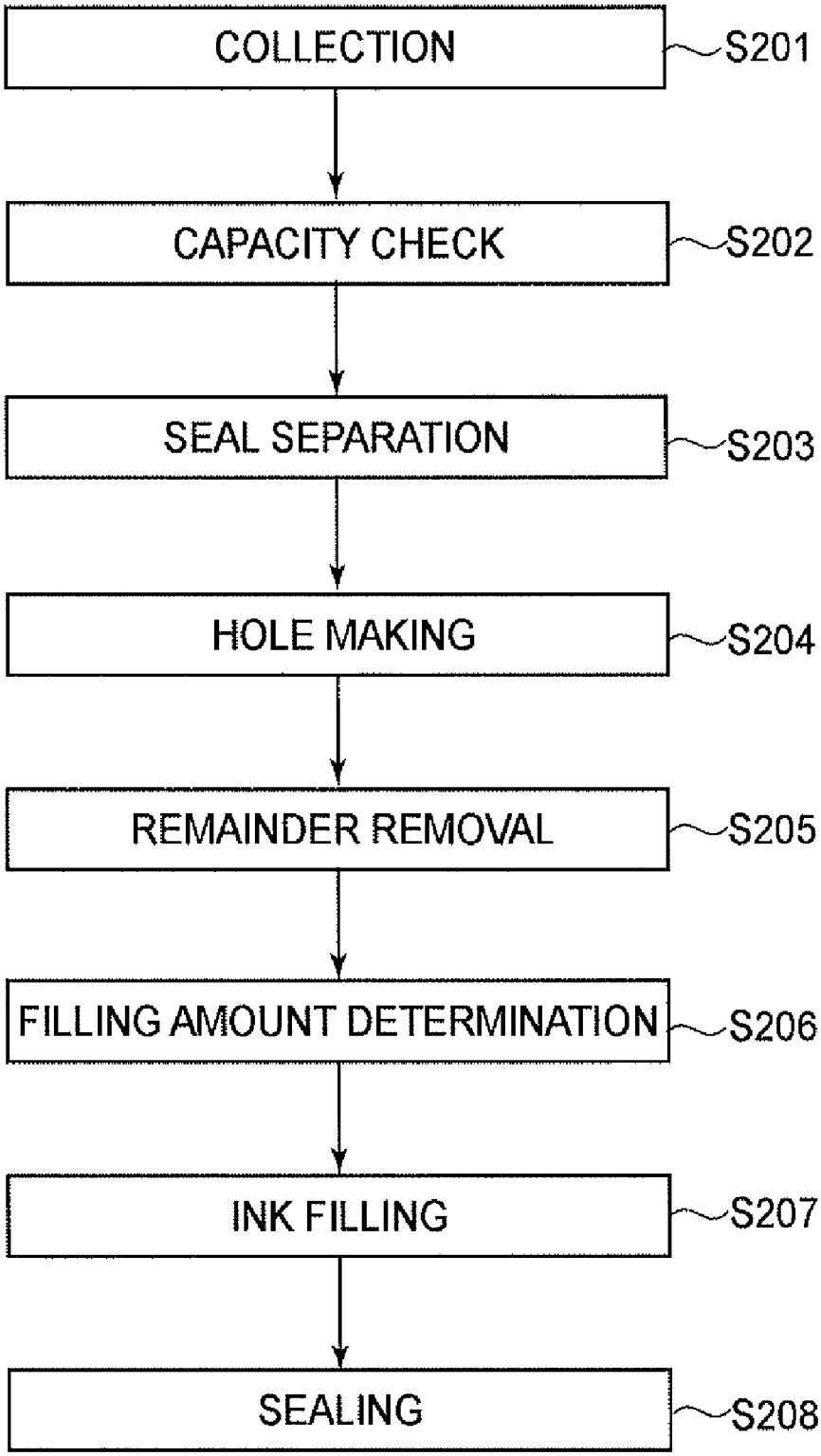
FIG. 12 is a flowchart of the ink jet cartridge refilling process in the second embodiment of the present invention.

FIG. 11(*a*) is a perspective view of the color ink jet cartridge immediately after its three ink storage chambers have been satisfactorily refilled with three inks different in color, one for one. The holes 210*a* and 210*b* are the holes made for measuring the amount of cyan ink remainder, and also, for injecting cyan ink into the cyan ink storage chamber. The holes 210*c* and 210*d* are the holes made for measuring the amount of magenta ink remainder, and also, for injecting magenta ink. The holes 210*e* and 210*f* are the holes made for measuring the amount of yellow ink remainder, and also, for injecting yellow ink. If the holes are left as they are, the inks easily evaporate through the holes. Therefore, in order to prevent the inks from evaporating through the holes 210, a new seal 600 (label), such as the one shown in FIG. 11(*b*), is pasted to the top lid H1901 to seal the holes 210 as shown in FIG. 11(*c*).

Incidentally, information, such as the refill history of the ink jet cartridge, which is useful for ink jet cartridge management, may be recorded on the label 600. Recording such information on the label 600 pasted on a refilled ink jet cartridge makes it easier to carry out the "absorbing member capacity finding step: S102" when the refilled ink jet cartridge is brought back next time for refilling.

Through the steps, such as those described above, the process for refilling the recovered used ink jet cartridge is completed.

[Embodiment 2]

Next, referring to FIG. 2, the second embodiment of the present invention will be described.

This embodiment is different from the first embodiment only in that an "ink remainder extracting step: S205" is carried out in place of the "ink remainder amount finding step: S102". Thus, only the difference of this embodiment from the first embodiment will be described.

Also in the second embodiments the "used cartridge recovery step: S201", "absorbing member capacity finding step: S202", "seal removing step: S203", and "hole making step: S204" are carried out.

Thereafter, the "ink remainder extracting step: S205" is carried out, which will be described next.

The multiple ink storage chambers in a recovered color ink jet cartridge are different in the amount of ink remainder therein, because of the different in the purpose for which each used ink jet cartridge was used, condition under which each used ink jet cartridge was used, and the like factors, as described before. This step for extracting the ink remainder is for erasing the difference among the multiple (three) ink storage chambers in the amount of ink remainder. In other words, this step is for equalizing all the ink storage chambers of a used ink jet cartridge in terms of the amount of ink therein. That is, as the ink remainder in each ink storage chamber is extracted, all ink storage chambers become empty, that is, practically free of ink, as they were before they were filled with ink for the first time. Thus, in the following step, that is, the "ink injection amount deciding step", it can be simply decided that all ink storage chambers are to be filled with the same amount of ink as the amount by which they were initially filled.

Figure 13:
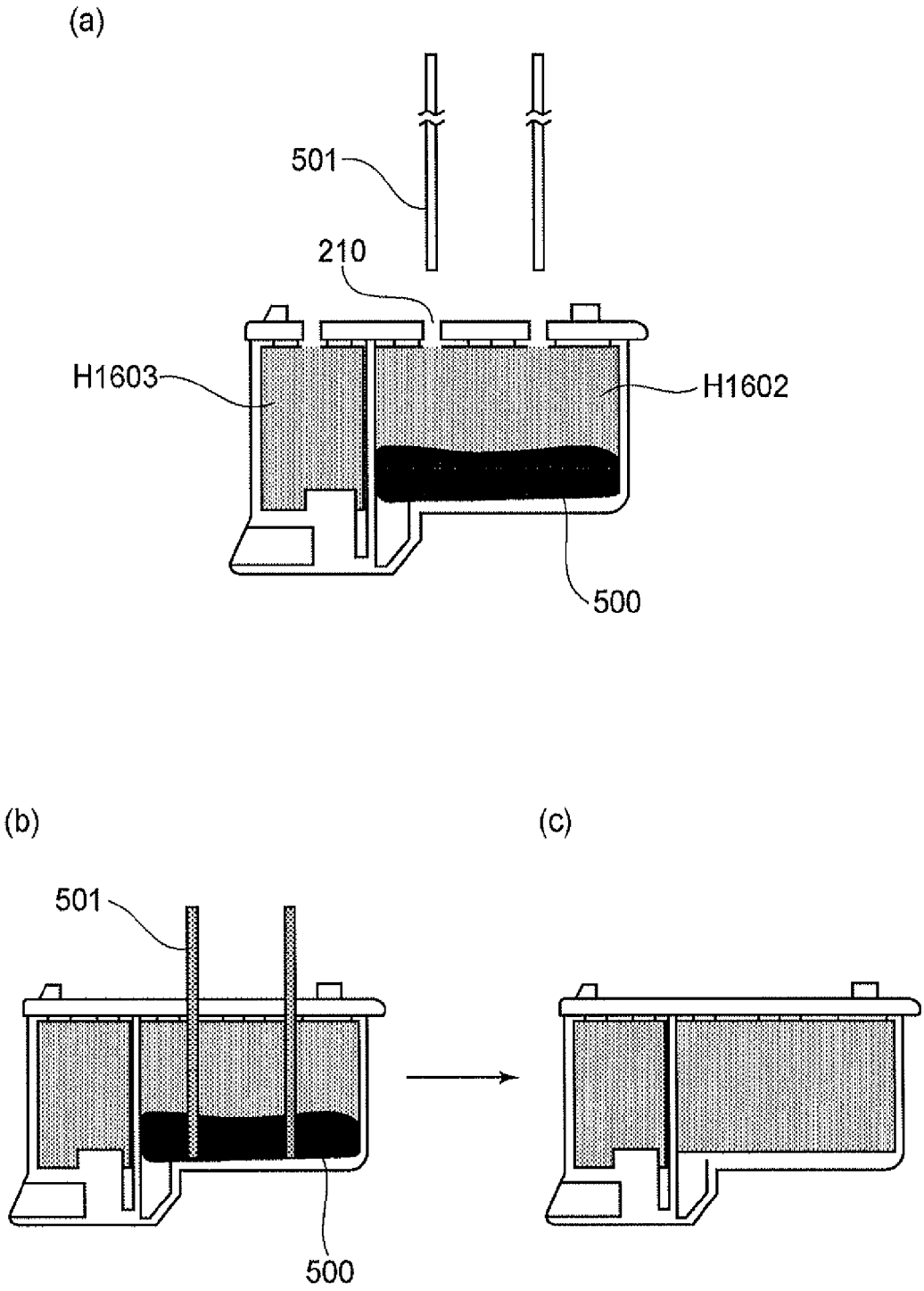
FIG. 13 is a schematic drawing for describing the "ink remainder extracting step" in the second embodiment of the present invention, FIG. 13(*a*) being a schematic sectional view of a combination of the ink jet cartridge, and a pair of ink extraction tubes of an ink extracting device, which are ready to be inserted into the ink jet cartridge, FIG. 13(*b*) being a schematic sectional view of a combination of the ink jet cartridge, and the pair of ink extraction tubes of the ink extracting device, which have just been inserted into the ink jet cartridge, and FIG. 13(*c*) being a schematic sectional view of the ink jet cartridge from which the entirety of the ink remainder therein has just been extracted.

FIG. 13 is a schematic drawing for describing an example of the "ink remainder extracting step: S205". Designated by alphanumeric symbols H1603 and H1602 are the absorbing members for magenta and cyan inks, respectively. The "ink remainder extracting step" will be described referring to the case of the used ink jet cartridge, shown in FIG. 13(*a*), the magenta ink of which has been used up, but, the cyan ink of which has not been used up. First, a pair of ink extracting needles 501 are inserted, as ink extracting devices, through the pair of holes made in the hole making step, as shown in FIG. 13(*a*). In order to ensure that the entirety of the ink remainder in the absorbing member H1602 is extracted, it is desired that the pair of needles 500 are inserted close to the bottom surface of the absorbing member H1602 as shown in FIG. 13(*b*). Thereafter, the ink remainder is to be extracted so that the absorbing member H1602 become practically free of ink as shown in FIG. 13(*c*). The "ink remainder extracting step" is continued until ink stops coming out of the ink extraction needles 501.

The "ink remainder extracting step" is ended as ink stops coming out of the ink extraction needles 501. In a case where yellow and/or cyan ink remains in a recovered used ink jet cartridge, the same step as that carried out for cyan ink is carried out for yellow and/or cyan ink.

If it is sure that there is no ink remaining in a given ink storage chamber, the "ink remainder extracting step" does not need to be carried out for this ink storage chamber.

In the above, the case in which the three ink storage chambers are sequentially subjected to the "ink remainder extracting step" was described. However, it may be the same time that the "ink remainder extracting step" is carried out for the three ink storage chambers (cyan, magenta, and yellow ink storage chambers). Further, it may be any two among the three ink storage chambers that are subjected to the "ink remainder extracting" step at the same time, leaving the other to be subjected to the "ink remainder extracting step" separately from the two. Whether the multiple ink storage chambers are to be sequentially refilled or at the same time, or whether any two among the three ink storage chambers are to be refilled at the same time, whereas the other is refilled separately from the two, may be decided based on the type of the available ink injecting device, or the like factors. Further, the method used in the "ink remainder extracting step" to extract the ink remainder does not need to be the one described above. For example, the ink remainder may be extracted with the use of a suction pump, or the like, connected to a cap, while the ink ejection outlets remain covered with the cap.

Incidentally, the interior of each ink storage chamber may be washed clean by injecting cleaning liquid, or the like, into the ink storage chambers after the ink remainder extraction, and then, suctioning out the injected cleaning liquid or the like. Many of the recovered ink jet cartridges do not have information, such as their recovery routes, length of time having elapsed since they were discarded, or the like. Therefore, washing clean a recovered ink jet cartridge is one of the steps which are desired to be carried out before refilling the recovered ink jet cartridge.

Next, the "ink injection amount deciding step: S206" is carried out. The standard recording head cartridge in this embodiment is capable of holding roughly 10 g of ink per ink storage chamber, and the mini recording head cartridge in this embodiment is capable of holding roughly 5 g of ink per ink storage chamber. Thus, it is decided in "ink injection amount deciding step: S206" that in the case of a standard recording head cartridge, 10 g of ink is to be injected per ink storage chamber, whereas in the case of a mini recording head cartridge, 5 g of ink is to be injected per ink storage chamber, based on the information obtained in the "absorbing member capacity finding step: S202".

Next, an "ink injecting step: S207" is taken, in which ink is injected into each ink storage chamber by the amount decided in the "ink injection amount deciding step". The three ink storage chambers may be sequentially refilled, or at the same time, as they are in the first embodiment. Further, the "ink injecting step" may be designed so that any two among the three ink storage chambers are filled at the same time, and the other is refilled separately from the two. Further, in this embodiment, it is not by the amount decided based on the amount of ink remainder in each ink storage chamber, but, the amount decided based on the absorbing member capacity that each ink storage chamber is refilled. Therefore, each ink storage chamber of the ink jet cartridge is perfectly refilled; it is neither overfilled, nor insufficiently filled.

Thereafter, a "seal pasting step: S208" is taken, in which a seal 600 (label) is pasted to the top lid H1901 to prevent ink from evaporating (being wasted) through the holes 210. Further, information, such as refill history, which is useful for ink jet cartridge management, may be recorded on the label.

In the above, the present invention was described with reference to the ink jet cartridges structured so that their ink container portion and recording head portion were inseparable from each other. Obviously, the present invention is also applicable to an ink container separable from a recording head, more specifically, an ink container, the internal structure of which cannot be confirmed from outside the container, and which has multiple ink storage chambers which are the same in external appearance, but, are different in ink capacity. When the present invention is applied to such an ink container, the information storage medium attached to the ink container and holding the information regarding the ink container can be used in the "ink container capacity finding step".

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 160215/2007 filed Jun. 18, 2007 which is hereby incorporated by reference.

What is claimed is:

1. An ink refilling method capable of refilling ink into at least two kinds of ink cartridges including a first ink cartridge which has a first ink capacity and a second ink cartridge which has substantially the same outer configuration as the first ink cartridge and has a second ink capacity which is smaller than the first ink capacity, said method comprising:

a step of discriminating a kind of the ink cartridge;

a step of inserting a pair of electrodes into the ink cartridge to a predetermined position, based on a result of said discriminating step, wherein when said discriminating step discriminates the first ink cartridge, the pair of electrodes is inserted into the first ink cartridge by a first predetermined length from a top side of said first ink cartridge, and when said discriminating step discriminates the second ink cartridge, the pair of electrodes is inserted into the second ink cartridge by a second predetermined length which is larger than the first length from the top side of said second ink cartridge;

a step of detecting, while further inserting the pair of the electrodes beyond the predetermined position, an amount of the ink remaining in the ink cartridge, based on a depth of insertion at a time when a voltage between the electrodes changes;

a step of determining an amount of the ink to be supplied into the ink cartridge based on the result of said discriminating step and a result of said detecting step; and a step of filling, into the ink cartridge, the amount of the ink determined in said determining step.

2. A method according to claim 1, wherein said ink cartridge includes an ink container including a plurality of ink accommodating portions, and a recording head integral with the ink container, for ejecting the ink to effect recording on a recording material.

3. A method according to claim 2, further comprising a step of opening said ink accommodating portions, and a step of sealing the openings.

4. A method according to claim 1, wherein the ink cartridge is provided with storing means, and said discriminating step is effected using said storing means.

5. A method according to claim 4, wherein said storing means includes a fuse.

6. A method according to claim 3, wherein said opening step includes a step of inserting an opening tool into the ink cartridge, wherein a depth of insertion of the tool is dependent on the result of said discriminating step.

7. A method according to claim 2, further comprising a step of determining amounts of the ink to be filled into the respective ink accommodating portions, said filling amount determining step including a step of measuring remaining amounts of the ink in the respective accommodating portions, wherein said filling amount determining step determines the filling amounts based on differences between the ink capacities of the accommodating portions and the remaining amounts of the ink measured by said measuring step, respectively.

8. A method according to claim 7, wherein said filling amount determining step includes a step of exhausting the remaining ink and determines the filling amount as being the ink capacity.

* * * * *